US006937261B2

(12) United States Patent
Kamata

(10) Patent No.: US 6,937,261 B2
(45) Date of Patent: Aug. 30, 2005

(54) METHOD FOR DRIVING PAPER-FEEDING STEPPING MOTOR IN THERMAL PRINTER

(75) Inventor: Tomoya Kamata, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 895 days.

(21) Appl. No.: 09/881,486

(22) Filed: Jun. 14, 2001

(65) Prior Publication Data

US 2001/0052988 A1 Dec. 20, 2001

(30) Foreign Application Priority Data

Jun. 16, 2000 (JP) ..... 2000-181427

(51) Int. Cl.[7] ..... B41J 11/00
(52) U.S. Cl. ..... 347/218
(58) Field of Search ..... 347/218, 221, 347/180, 181, 187, 172; 400/120.12, 120.13, 120.05, 120.02; 358/296

(56) References Cited

U.S. PATENT DOCUMENTS 4,113,391 A * 9/1978 Minowa ..... 400/120.12
4,449,152 A * 5/1984 Kurata et al. ..... 358/296
4,652,806 A 3/1987 Aiello
6,518,992 B1 * 2/2003 Jimbo ..... 347/180

FOREIGN PATENT DOCUMENTS

| | | |
|---|---|---|
| EP | 0882596 A2 | 12/1998 |
| JP | 06328758 | 11/1994 |
| JP | 09065694 | 3/1997 |
| JP | 10323091 | 12/1998 |
| JP | 11-320941 | 11/1999 |

* cited by examiner

*Primary Examiner*—K. Feggins
(74) *Attorney, Agent, or Firm*—Brinks Hofer Gilson & Lione

(57) ABSTRACT

In order to provide a paper-feeding stepping motor driving method which inhibits the torque of a paper-feeding stepping motor of a line-type thermal printer, which is driven in response to the divisional energization of heating elements, from excessively increasing during dynamic division printing, and which achieves noise reduction and energy conservation, while a driving signal to be applied to the paper-feeding stepping motor is active, an active pulse is subdivided.

2 Claims, 7 Drawing Sheets

METHOD FOR DRIVING PAPER-FEEDING STEPPING MOTOR IN THERMAL PRINTER

BACKGROUND OF THE INVENTION

This application claims the benefit of priority to Japanese Patent Application 2000-181427, filed on Jun. 16, 2000.

1. Field of the Invention

The present invention relates to a method for driving a paper-feeding stepping motor in a thermal printer, and more particularly, to a method for driving a paper-feeding stepping motor in a thermal printer which performs so-called dynamic division printing in which a desired image is recorded line by line by divisionally energizing heating elements so that the number of the heating elements to be simultaneously energized for each line is less than or equal to a predetermined number.

2. Description of the Related Art

Conventionally, stepping motors are used as carriage motors for driving carriages or paper-feeding motors for feeding recording paper in printers because the rotation angle and speed of the motors are determined in proportion to the input pulse number and the input pulse speed, the starting and stopping characteristics are far superior, and a high responsiveness and a high power can be obtained.

A line-type thermal printer will be described as an example in which such a stepping motor is used as a stepping motor for feeding recording paper. In a line-type thermal printer, a long platen roller is rotatably supported between a pair of side frames, and a line thermal head is supported in a printer body by a support lever so as to be moved closer to and further apart from the platen roller. The line thermal head has, in its rear side, head-pressing springs. The line thermal head also has an array of heating elements arranged in a longitudinal direction. An energization control section is electrically connected to the heating elements so as to selectively control the energization of the heating elements based on the recording data.

On the other hand, a paper-feeding stepping motor is mounted in the printer body. A delivery roller is linked with a driving shaft of the paper-feeding stepping motor via a transmission gear train so as to take thermosensitive sheets (thermal recording sheets) out of a paper tray and to supply the sheets between the platen roller and the line thermal head. A feeding control section is connected to the paper-feeding stepping motor via a motor driver.

In order to perform recording by the line-type thermal printer having such a configuration, first, the paper-feeding stepping motor is driven and the delivery roller is rotated, thereby feeding thermal recording sheets one by one from the paper tray, and supplying the thermal recording sheets between the platen roller and the line thermal head. When a thermal recording sheet is conveyed to a recording start position, the line thermal head is pressed against the platen roller with the thermal recording sheet and the ink ribbon therebetween, the energization control section selectively energizes the heating elements based on the recording data, and the thermal recording thereby develops color. When the recording of the first line is completed, the paper-feeding stepping motor is driven, and the recording of the second line is started based on the recording data. In this way, the recording is continued to the final line.

A description will now be given of the energization control of the heating elements of the line thermal head by the energization control section. Hitherto, when energizing the heating elements, a so-called dynamic division printing is performed in order to reduce the power consumption, in which the heating elements are energized in arbitrary divisions so that the number of heating elements to be simultaneously energized for one line is less than or equal to a predetermined number, as shown in FIG. 7.

According to such dynamic divisional printing, the power to be supplied at one time can be reduced. Moreover, since the number of divisions is not fixed, but is set to be best-suited to the required number of heating elements to be energized for printing each line, the printing speed does not become excessively slow.

In the conventional method for driving the paper-feeding stepping motor of the thermal printer, however, since the number of divisions for energization is set for each line, it often varies from line to line. The paper-feeding stepping motor is driven by applying active pulses of a fixed voltage regardless of the number of divisions. For this reason, in the case of a line which is recorded in a large number of divisions, the torque excessively increases and this produces noise.

That is, as the number of divisions increases, the energizing time necessary for the recording of one line increases, and active low and high outputs corresponding to the phases are applied to a driving line for controlling the paper-feeding stepping motor for a long period. For this reason, force for reducing the rotational inertia force is applied, and noise is thereby produced.

SUMMARY OF THE INVENTION

The present invention has been made in view of such problems, and an object of the invention is to provide a paper-feeding stepping motor driving method which inhibits the torque of a paper-feeding stepping motor from excessively increasing during dynamic division printing, and which achieves noise reduction and energy conservation.

In order to achieve the above object, according to an aspect of the present invention, there is provided a paper-feeding stepping motor driving method in a thermal printer wherein, while a driving signal applied to a paper-feeding stepping motor to be driven in response to the divisional energization of heating elements is active, an active pulse is subdivided.

This makes it possible to shorten the energizing time of the motor, to inhibit an excessive increase of torque, to reduce noise, and to save energy.

Preferably, the active pulse is subdivided when the number of divisions for energization of the heating elements is more than or equal to two.

Preferably, the active pulse is subdivided into a predetermined duty ratio and into a predetermined pulse width corresponding to the number of divisions. This makes it possible to optimally and smoothly inhibit an excessive increase of torque, to reduce noise, and save energy.

Further objects, features, and advantages of the present invention will become apparent from the following description of the preferred embodiments (with reference to the attached drawings).

DESCRIPTION OF THE PREFERRED EMBODIMENTS

A method for driving a paper-feeding stepping motor of a thermal printer according to an embodiment of the present invention will be described below with reference to the drawings.

The paper-feeding stepping motor driving method in the thermal printer of the present invention is characterized in that, while a driving signal to be applied to a paper-feeding stepping motor 7, which is driven in response to the divisional energization of heating elements for dynamic division printing, is active, an active pulse is subdivided. Herein, dynamic division printing means a recording method in which the number of heating elements to be energized for recording each line with each color is found and divisional energization is performed so that the number of heating elements to be energized at one time is less than or equal to a predetermined number. The number of heating elements to be energized is found based on, for example, recording data.

Figure 1:
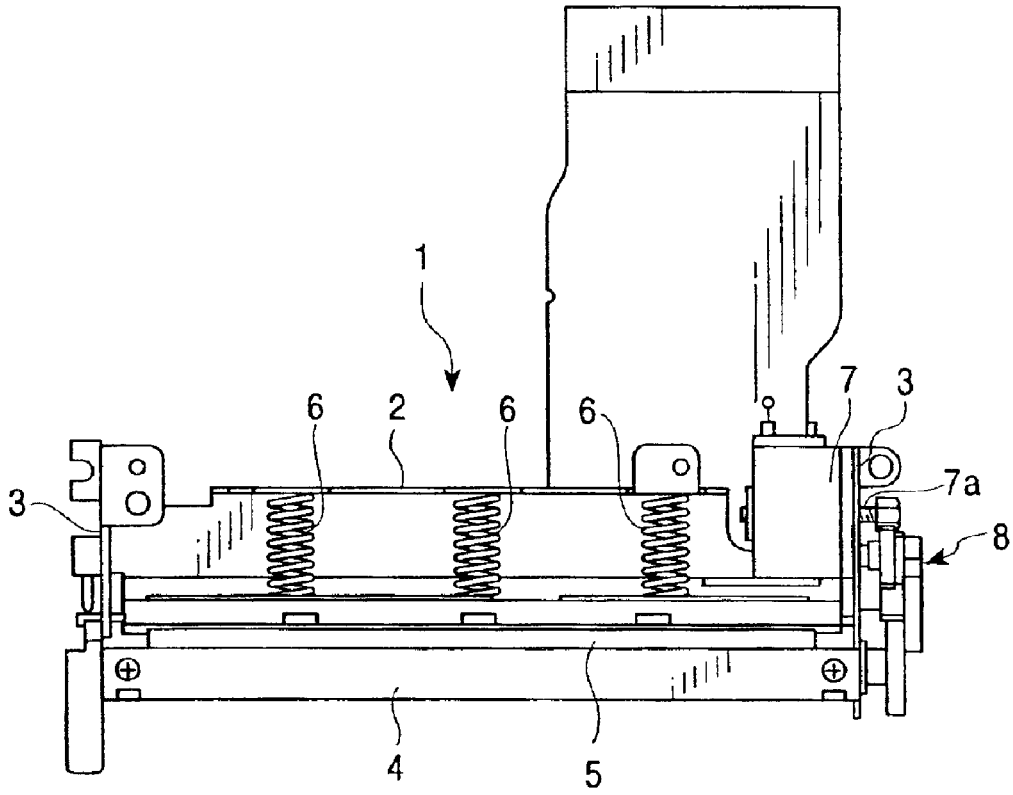
FIG. 1 is a plan view of an embodiment of a line printer which carries out a paper-feeding stepping motor driving method according to the present invention.

FIG. 1 shows an example of a line-type thermal printer 1 which carries out the driving method of the paper-feeding stepping motor 7 according to the present invention. In the line-type thermal printer 1, a pair of side frames 3 are mounted on the side faces of a printer body 2, and a long platen roller 4 is rotatably supported therebetween. In the printer body 2, a line thermal head 5 having an array of heating elements is supported so as to be moved closer to and further apart from the platen roller 4. The line thermal head 5 is provided with a plurality of head-pressing springs 6 for applying a pressing force toward the back side thereof.

The paper-feeding stepping motor 7 is also mounted in the printer body 2. A delivery roller (not shown) is connected to a driving shaft 7*a* of the paper-feeding stepping motor 7 via a transmission gear train 8. The delivery roller takes thermal recording paper out of a paper tray (both not shown) and supplies the paper between the platen roller 4 and the line thermal head 5.

Figure 2:
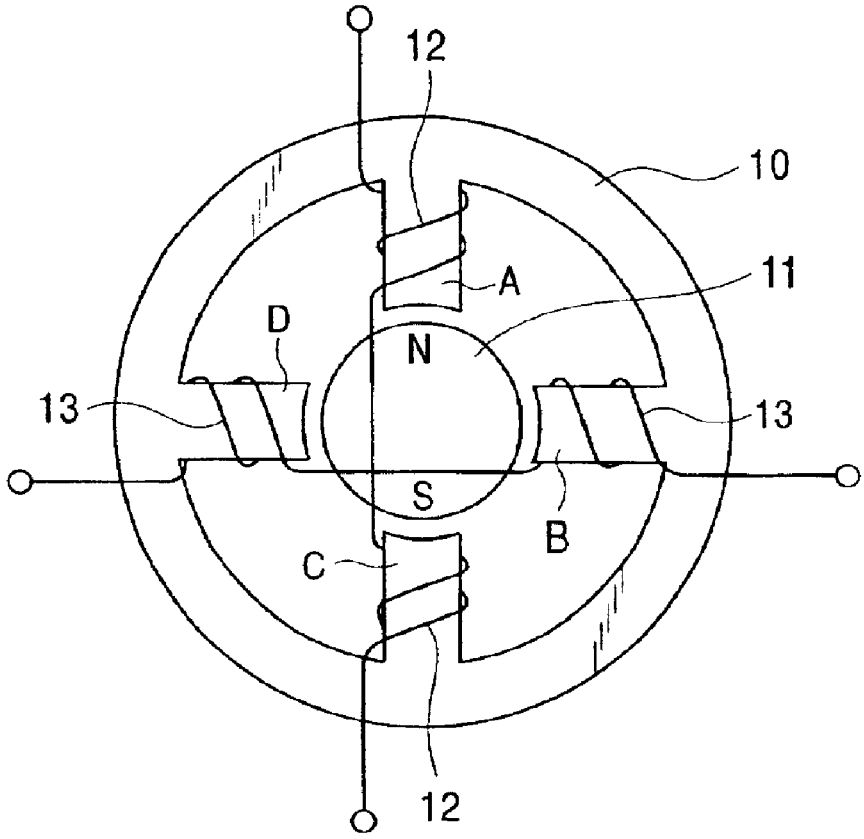
FIG. 2 is a principle view explaining the structure of a paper-feeding stepping motor.

In this embodiment, a bipolar four-phase motor is used as an example of the paper-feeding stepping motor 7. As shown in FIG. 2, the paper-feeding stepping motor 7 includes a stator 10 having first, second, third, and fourth magnetic poles (phases) A, B, C, and D spaced at 90 degrees, and a rotor 11 formed of a permanent magnet having N and S poles spaced at 180 degrees. The rotor 11 is linked with an output shaft (not shown). A first coil 12 is formed around the first and third magnetic poles A and C, and a second coil 13 is formed around the second and fourth magnetic poles B and D.

When an exciting current (phase current) serving as a driving signal is applied to the coils 12 and 13 of the phases in the stator 10 in order to rotationally drive such a stepping motor 1, a magnetic field is established by the current, and an attractive or repulsive electromagnetic force is generated between the stator 10 and the rotor 11. By sequentially switching the phase current, the electromagnetic force between the stator 10 and the rotor 11 is switched, thereby forming a torque for moving the rotor 11.

Figure 3:
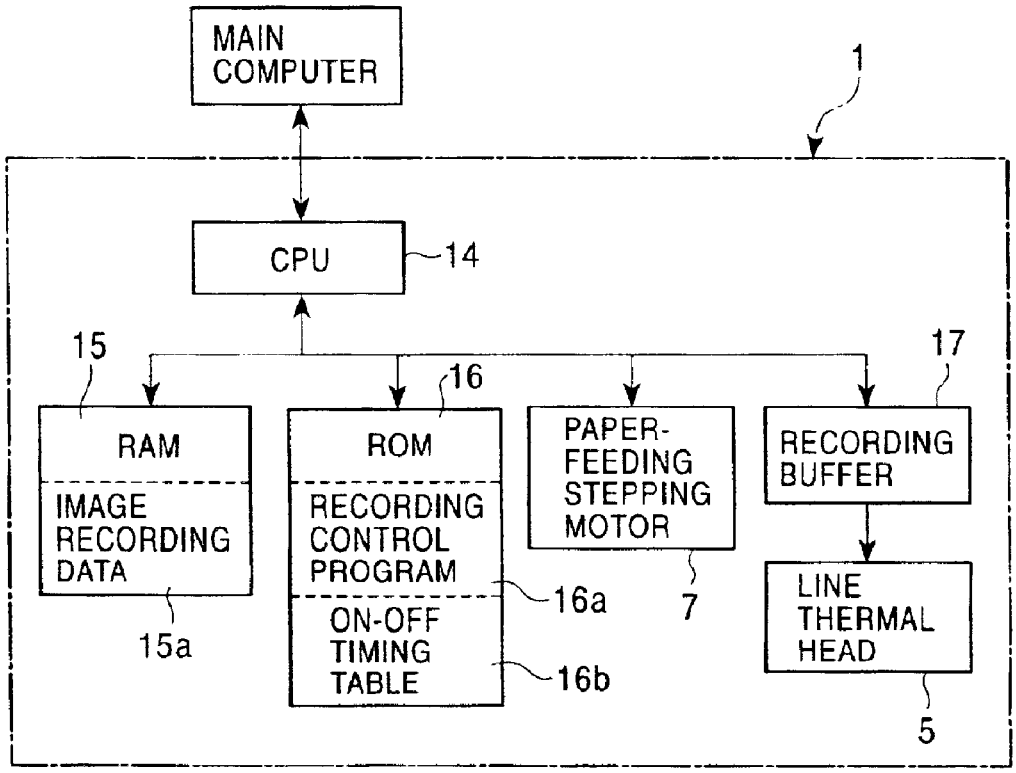
FIG. 3 is a block diagram concerning the printing control and the recording paper feeding control in the line printer shown in FIG. 1.

In this embodiment, feeding of the thermal recording paper and recording by the line thermal head 5 are controlled by a CPU 14 based on image recording data 15*a* and a recording control program 16*a* stored in a RAM 15 or a ROM 16, as shown in FIG. 3 as a block diagram. That is, the RAM 15 stores the image recording data 15*a* transmitted from a main computer. The ROM 16 stores the recording control program 16*a* for calculating the number of dynamic divisions based on the image recording data 15*a*. The ROM 16 also stores an on-off timing table 16*b* for the paper-feeding stepping motor 7 based on the number of divisions of an active pulse.

Figure 4:
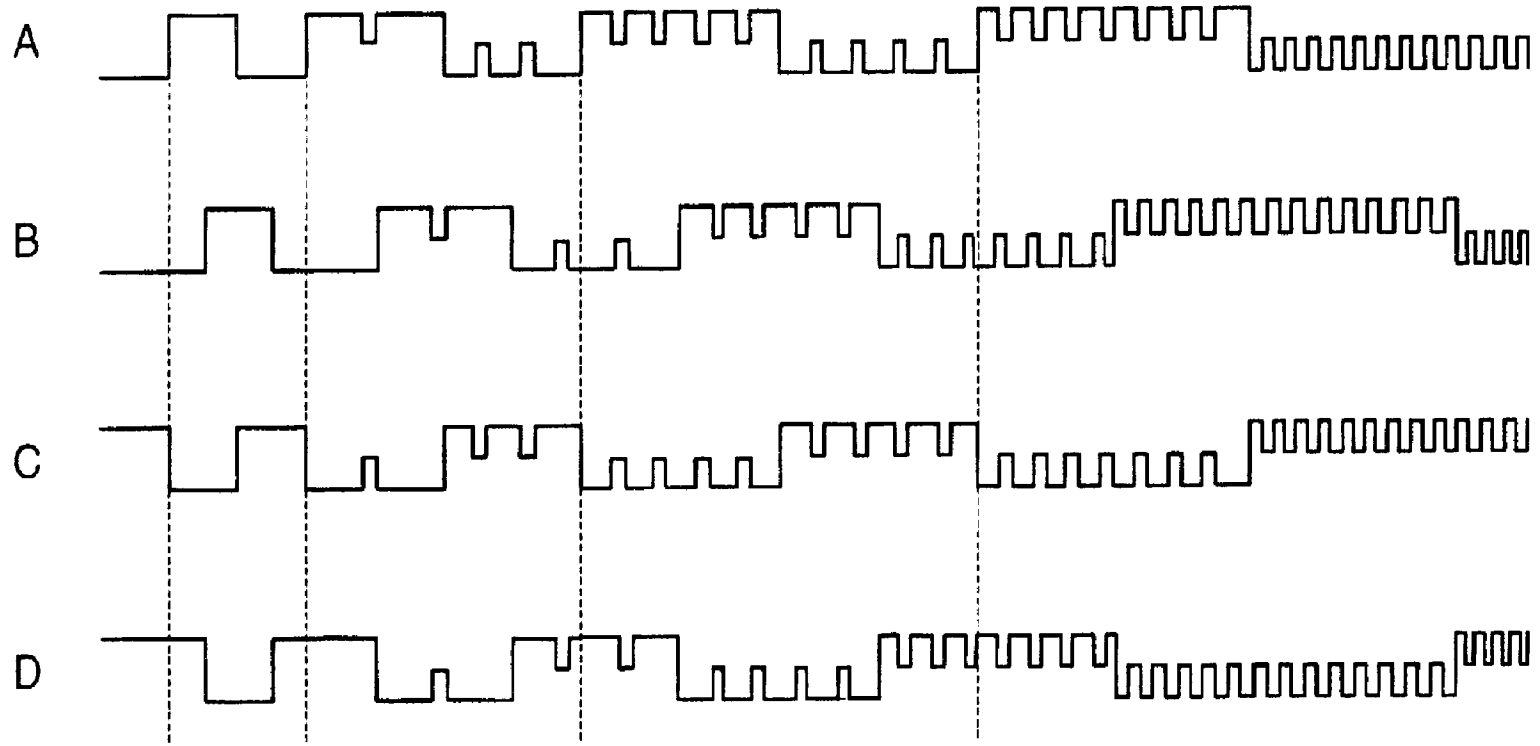
FIG. 4 is a pulse waveform chart showing a state in which an active pulse is subdivided into a predetermined duty ratio and a predetermined pulse width.

As shown in FIG. 4, duty ratios and pulse widths are preset in the on-off timing table 16*b* so as to subdivide an active pulse. By querying the number of divisions, an active pulse is instantaneously given in a predetermined subdivided form. Herein, the duty ratio means the ratio of the ON time of the HIGH pulses to a period for which the HIGH and LOW pulses are applied, that is, the duty cycle. Therefore, in this embodiment, when subdividing an active pulse, the duty ratio and the HIGH and LOW pulse widths thereof are set.

Next, a method for driving the paper-feeding stepping motor 7 of this embodiment will be described with reference to flowcharts shown in FIGS. 5 and 6.

Figure 5:
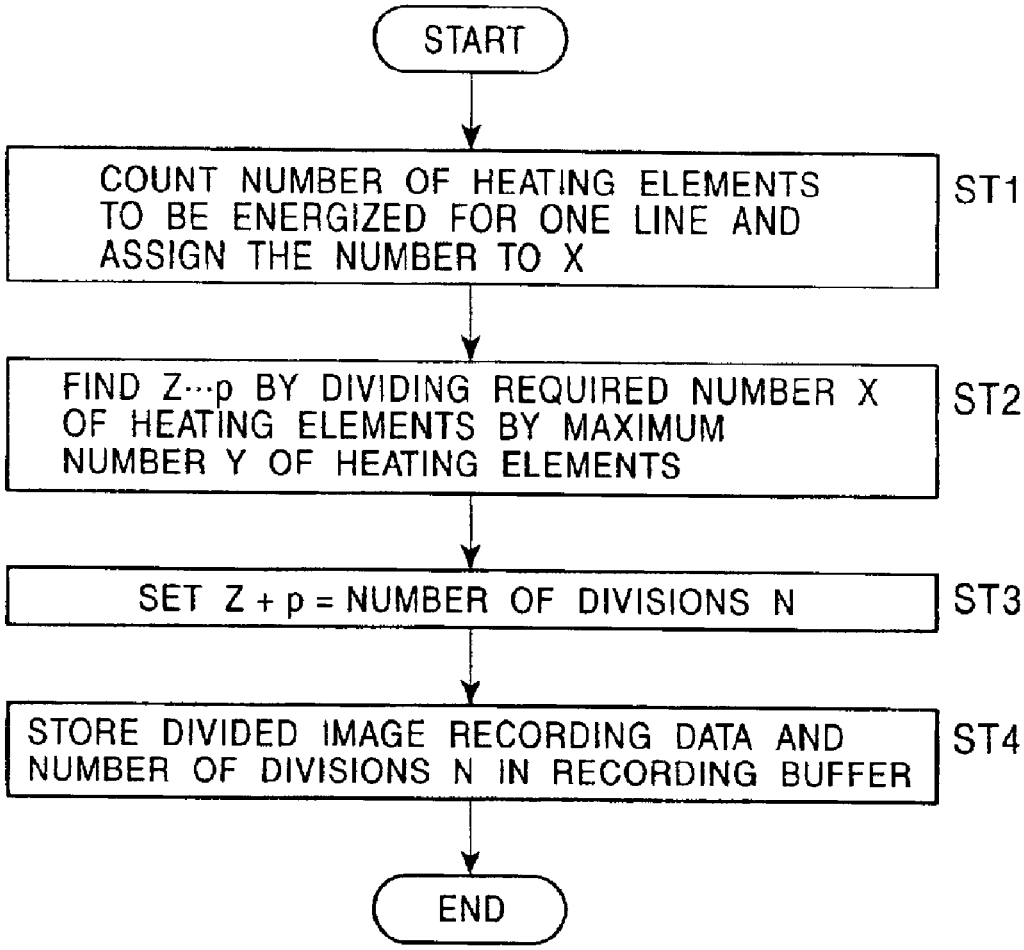
FIG. 5 is a flowchart showing a procedure for expanding recording data in this embodiment.
Figure 6:
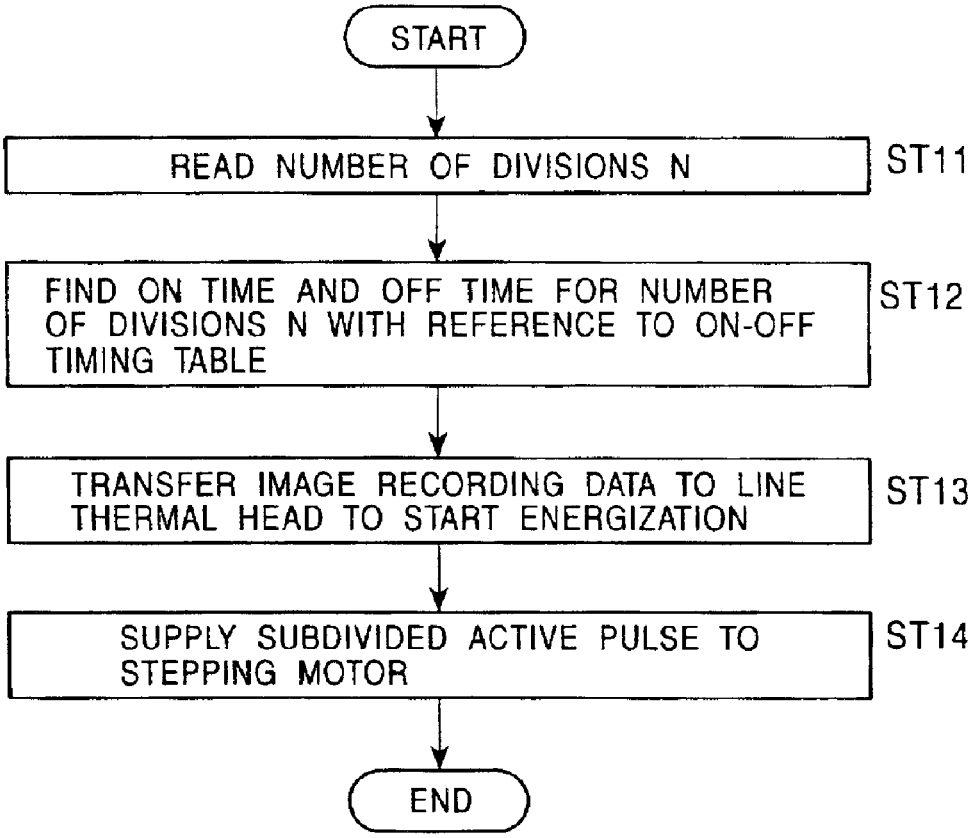
FIG. 6 is a flowchart showing a procedure of recording control in this embodiment.
Figure 7:
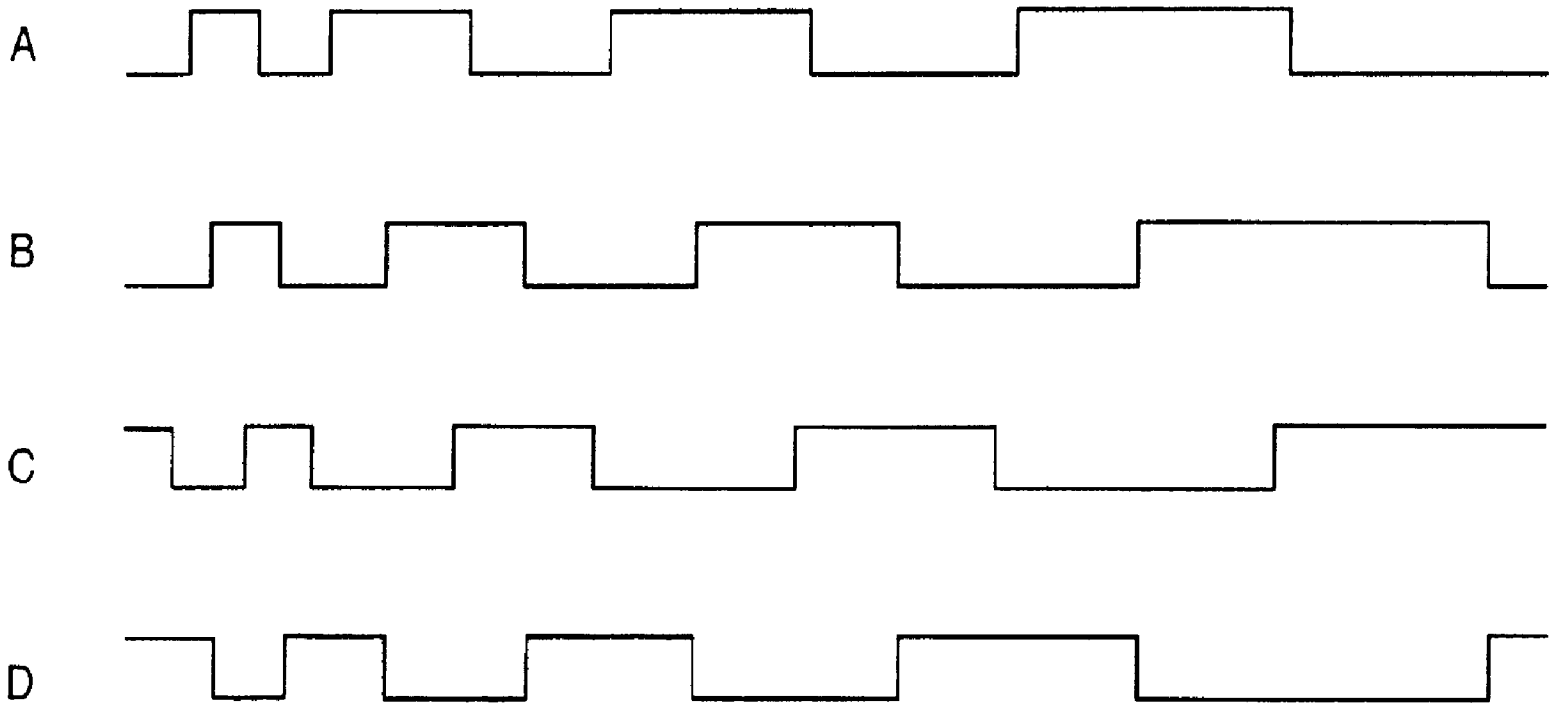
FIG. 7 PRIOR ART
FIG. 7 is a pulse waveform chart showing a case in which an active pulse is subjected to dynamic division in a conventional paper-feeding stepping motor driving method.

FIG. 5 shows a procedure for expanding the image recording data 15*a* in this embodiment. In Step ST1, the number of heating elements to be energized for one line is counted based on the image recording data 15*a* stored in the RAM 15, and is assigned to X. In the next Step ST2, Z with remainder p is found by dividing the value X by a predetermined largest possible number Y of heating elements to be energized simultaneously. In Step ST3, Z+p is set as the number of divisions N. In the next Step ST4, image recording data 15*a* for one line is divided into N-number of line data, and is stored in a recording buffer 17 with the number of divisions N. The expansion of the image recording data 15*a* is thereby completed.

Subsequently, in a recording control procedure shown in FIG. 6, the number of divisions N stored in the recording buffer 17 is fetched in Step ST11, and a subdivided state of an active pulse corresponding to the number of divisions N, that is, the ON time Ton and the OFF time Toff, are obtained by consulting the on-off timing table 16*b* of the paper-feeding stepping motor 7, in which the number of divisions N serves as a key, stored in the ROM 16 about the number of divisions N.

In the next Step ST13, the image recording data 15*a* is transferred to the line thermal head 5, and energization is started. In this case, in Step ST14, a cycle, in which the paper-feeding stepping motor 7 is activated for the period Ton and is deactivated for the period Toff, is continued until the paper-feeding stepping motor 7 rotates one step. Recording of one line with the first color is thereby completed.

According to such a driving method of the paper-feeding stepping motor 7 in this embodiment, since the active pulse to be applied to the paper-feeding stepping motor 7 is subdivided into a predetermined duty ratio and a predetermined pulse width corresponding to the number of dynamic divisions, it is possible to optimally and smoothly shorten the energizing time of the motor, to inhibit an excessive increase of torque, to reduce noise, and to save energy.

While the duty ratio and the pulse width corresponding to the number of divisions are found in a predetermined manner with reference to the on-off timing table 16*b* when subdividing the active pulse in this embodiment in order to attain quick processing, they may be found by operational expressions.

While the present invention has been described with reference to what is presently considered to be the preferred embodiment, it is to be understood that the invention is not limited to the disclosed embodiment. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A driving method for a paper-feeding stepping motor in a thermal printer, the method comprising:

driving the paper-feeding stepping motor and feeding recording paper by applying a driving signal with an active pulse;

determining a number of heating elements to be energized for recording each line with each color;

performing simultaneous divisional energization such that the number of heating elements is not greater than a predetermined number; and subdividing the active pulse while the driving signal is active, the active pulse being subdivided when a number of divisions for energization of said heating elements is not less than two.

2. A driving method for a paper-feeding stepping motor in a thermal printer according to claim 1, the subdividing further comprising subdividing the active pulse into a predetermined duty ratio and a predetermined pulse width corresponding to the number of divisions.

* * * * *